US007281526B2

(12) United States Patent
Keiichiro et al.

(10) Patent No.: US 7,281,526 B2
(45) Date of Patent: Oct. 16, 2007

(54) LIQUID FUEL IMPROVING CATALYST AND LIQUID FUEL IMPROVING DEVICE STORING THE CATALYST

(76) Inventors: Asaoka Keiichiro, T243-0013 8-8 Izumicho Atsugi City Kanagawa, Atsuga, Kanagawa (JP) 243-0013; Nejime Hidetake, 76-3 Nakaima Naha City Okinawa, Naha, Okinawa (JP)

( * ) Notice: Subject to any disclaimer, the term of this patent is extended or adjusted under 35 U.S.C. 154(b) by 33 days.

(21) Appl. No.: 11/408,889

(22) Filed: Apr. 24, 2006

(65) Prior Publication Data

US 2006/0260588 A1 Nov. 23, 2006

(51) Int. Cl.
*F02M 33/00* (2006.01)

(52) U.S. Cl. ..... 123/538

(58) Field of Classification Search ..... 123/536–538; 502/100; 60/723

See application file for complete search history.

(56) References Cited

U.S. PATENT DOCUMENTS 4,492,741 A 1/1985 Strithers
5,617,721 A 4/1997 Slawson
5,871,552 A 2/1999 Tada
6,015,440 A 1/2000 Noureddini
6,174,501 B1 1/2001 Noureddini
6,451,468 B1 9/2002 Adachi
6,851,413 B1 * 2/2005 Tamol, Sr. ..... 123/536
6,855,178 B2 2/2005 Uchida et al.
2005/0241626 A1 * 11/2005 Hashimoto et al. ..... 123/538

FOREIGN PATENT DOCUMENTS

JP 410-46162 A * 2/1998
JP 2005-240152 * 9/2005

* cited by examiner

*Primary Examiner*—Marguerite McMahon
(74) *Attorney, Agent, or Firm*—Kirk A. Buhler; Buhler & Associates

(57) ABSTRACT

The present invention relates to liquid fuel reforming catalyst which reforms liquid fuel to have a more efficient combustion characteristic by using minus-ionizing in the fuel. The device improves the power output, fuel economy, reduces the Particulate Material (PM) in the exhaust gas, and relates to a liquid fuel reforming device which contains a liquid fuel reforming catalyst utilizing tourmaline, far-infrared radiation emitting substance, alumina and binding material crushed into powder, mixed, granulated and calcined.

11 Claims, 1 Drawing Sheet

LIQUID FUEL IMPROVING CATALYST AND LIQUID FUEL IMPROVING DEVICE STORING THE CATALYST

CROSS REFERENCE TO RELATED APPLICATION

This application claims priority to Japan application number 2005-127138 filed on May 19, 2005.

DESCRIPTION

Field of the Invention

The present invention relates to the liquid fuel reforming catalyst which reforms liquid fuel to have improved efficient combustion character and relates to a liquid fuel reforming device which contains the catalyst.

BACKGROUND OF THE INVENTION

Environmental pollution by exhaust gas from internal combustion engine burning liquid fuel is and has been a big social problem.

In particular, Particulate Material (PM) that is contained in the exhaust gas from diesel engine which uses gas oil and heavy oil has been identified as a potential causes to cancer, bronchitis asthma and hay fever. It is desired to reduce PM to minimize or eliminated these problems.

There are PM reduction devices such as DFP (Diesel Particulate Filter) or oxidization catalyst which removes PM in the exhaust gas when installed directly in the line of exhaust pipe from diesel engine. These devices have some problem because they are installed directly in the exhaust pipe line and are a problem with maintenance on the device that filters and captures the PM requiring the device to be periodically emptied and otherwise maintained.

As a device to clean the exhaust gas, some liquid fuel reforming devices are known to reform liquid fuel into fuel with better quality and better fuel economy by the effect of catalyst which generates minus ion or far-infrared radiation in order to make complete combustion of the fuel in engine. (for example Prior Art 1) Japanese Patent 2887703

The Tourmaline, described in the Prior Art 1 and used for the liquid fuel reforming device, does not show strong self-polarization characteristic and does not have enough ionization ability. The Tourmaline has a characteristic to self-polarize by heat or pressure and the Tourmaline emits minus-ions to ionize air or water in the vicinity.

The liquid fuel reforming device described in the Prior Art 1 does not reform liquid fuel sufficiently because the catalyst ceramic and the far-infrared radiating ceramic are contained in a container separately. Heat transferred to the tourmaline with far-infrared radiation from the far-infrared radiation emitting substance is insufficient to induce self-polarization of the tourmaline and the minus-ions that are generated are not strong enough to reform the liquid fuel sufficiently.

BRIEF SUMMARY OF THE INVENTION

It is an object of the liquid fuel reform catalyst to provides a liquid fuel reforming catalyst which is composed with tourmaline, far-infrared emitting substance, alumina and binding material after being crushed into powder, mixed, granulated and calcined.

It is another object of the liquid fuel reform catalyst to provide the liquid fuel reforming catalyst that is formed into spherical shaped particles of between 0.5-5 mm diameter.

It is another object of the liquid fuel reform catalyst to provide the liquid fuel reforming catalyst where the tourmaline is black tourmaline.

It is another object of the liquid fuel reform catalyst to provide the liquid fuel reforming catalyst in a mixing ratio of tourmaline is 5-15% by unit weight.

It is another object of the liquid fuel reform catalyst to provide the liquid fuel reforming catalyst where the far-infrared radiation emitting substance is obsidian.

It is another object of the liquid fuel reform catalyst to provide the liquid fuel reforming catalyst with the mixing ratio of obsidian is 5-15% by unit weight.

It is another object of the liquid fuel reform catalyst to provide the liquid fuel reforming catalyst with the mixing ratio of alumina and binding material of 70-90% by unit weight.

It is another object of the liquid fuel reform catalyst to provide the liquid fuel reforming catalyst where the catalyst is calcined at 700-900 Deg. C.

It is another object of the liquid fuel reform device where the device is filled with a liquid fuel reforming catalyst that is installed in the flow line of a liquid fuel.

It is another object of the liquid fuel reform catalyst to provide the liquid fuel reforming device where the device is filled with a liquid fuel reforming catalyst in a container with the inlet and outlet of fuel.

It is another object of the liquid fuel reform catalyst where the liquid fuel reform catalyst is installed in the vicinity of engine, exhaust gas pile, oil pan or radiator of vehicle.

ADVANTAGES OF INVENTION

The liquid fuel reform catalyst is made of tourmaline, far-infrared radiation emitting substance, alumina and binding material after being crushed into powder, mixed, granulated and calcined, can improve the output power and fuel economy of internal combustion engine and also can reduce particulate material in the exhaust gas, by reforming the liquid fuel to have high combustion efficiency after being effectively ionized by the tourmaline in the catalyst with the effect of polarization induced by the heat of far-infrared radiation from the far-infrared radiation emitting substance and by the pressure from the micro-vibration of alumina.

It is another advantage of the liquid fuel reform catalyst to reform the liquid fuel in minus-ionizing effectively by granulating the catalyst into 0.5-5 mm diameter particle with large surface area to contact. This configuration also has an advantage of keeping the flow pass of liquid fuel in the space between the granulated catalyst where the catalyst is more than 0.5 mm diameter spherical shape.

It is another object of the liquid fuel reform catalyst to provide a liquid fuel reforming catalyst with the advantage of reforming liquid fuel in minus-ionizing efficiently because the black tourmaline has strong self-polarization characteristic when used as a tourmaline composite in the catalyst.

It is another object of the liquid fuel reform catalyst to provide the catalyst with the advantage of reforming liquid fuel in minus-ionizing with the mixing ratio of black tourmaline as 5-15% by unit weight in which the black tourmaline is properly dispersed against the other composites in the catalyst without distinguishing its opposite electric charge each other.

It is another object of the liquid fuel reform catalyst to provide the liquid fuel reforming catalyst with the advantage of increasing the characteristic of ionization of tourmaline because obsidian, which emits the far-infrared radiation and induces the polarization onto the tourmaline, is used for the composite of far-infrared radiation emitting substance.

It is another object of the liquid fuel reform catalyst to provide a liquid fuel reforming catalyst with the advantage of reforming liquid fuel with the mixing ratio of obsidian as 5-15% by unit weight which constitutes preferred distribution and mixture with the other composites of the catalyst.

It is another object of the liquid fuel reform catalyst to provide a liquid fuel reforming catalyst with the advantage of increasing the ionization characteristic of tourmaline with the mixing ratio of alumina and binding material as 70-90% by unit weight with which the alumina, and binding material (s), forms enclosures to the tourmaline particles and the micro-vibration of alumina and binding material is effectively transferred to the tourmaline.

It is another object of the liquid fuel reform catalyst to provide a liquid fuel reforming catalyst with enhanced ionizing-characteristic of tourmaline by using mixed alumina which generates strong micro-vibration to pressurize the tourmaline after being calcined with the tourmaline at 700-900 Deg. C, below 950 Deg. C over which the polarity characteristic of black tourmaline disappears.

It is another object of the liquid fuel reform catalyst device which is filled with the liquid fuel reforming catalyst in the flow pass of the fuel line, has an advantage of reforming liquid fuel to have better combustion efficiency by ionizing the fuel which passes through the catalyst.

It is another object of the liquid fuel reforming catalyst device with the advantage of reforming liquid fuel into the fuel with efficient combustion characteristic by passing the fuel to be ionized through the liquid fuel reforming catalyst which is filled in the container having with the inlet and outlet for the fuel.

It is still another object of the liquid fuel reforming catalyst device to provide an advantage of increasing the ionization ability of the tourmaline by installing the catalyst container of the device in the vicinity of engine, exhaust gas pipe, oil pan or radiator of vehicle for conducting heat to the tourmaline in order to enhance its self-polarization characteristic.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
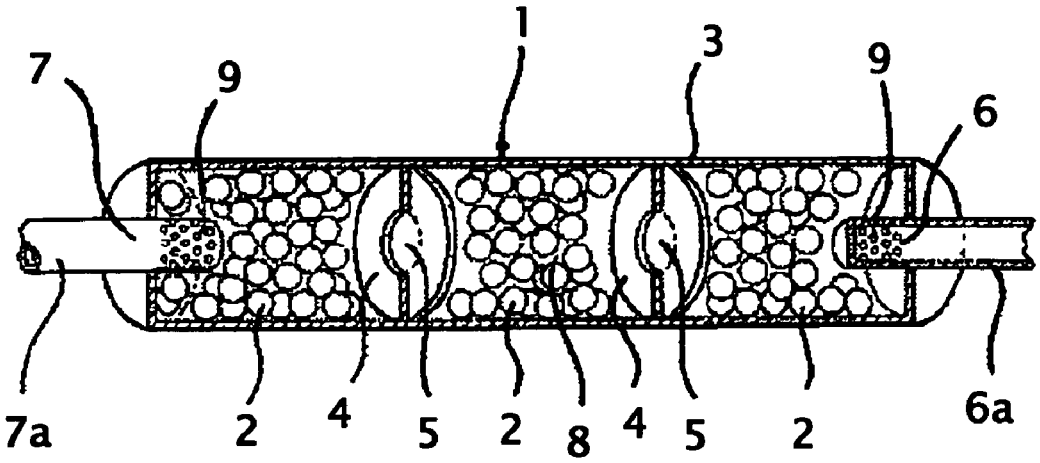
FIG. 1 shows a sectional drawing of the liquid fuel reforming device in a preferred embodiment.

FIG. 1 shows the liquid fuel reforming device 1 of the present invention filled with the liquid fuel reforming catalyst 2 in the flow path of the liquid fuel 8, and the catalyst 2 consists of tourmaline, far-infrared radiation emitting substance, alumina and binding material that has been crushed into powder, mixed, granulated and calcined.

EXAMPLE 1

One preferred embodiment of the present invention of the liquid fuel reforming catalyst is described below.

In the example shown in FIG. 1, black tourmaline is used for the tourmaline, obsidian is used for the far-infrared radiation emitting substance, and bauxite is used for the alumina and binding material.

After being crushed into powder for easy mixing, 10% by unit weight of black tourmaline, 10% by unit weight of obsidian and 80% by unit weight of bauxite are kneaded with water and then granulated with sphere shape of 2-3 mm diameter. The granulated mixture is then calcined at 800 Deg. C for the liquid fuel reforming catalyst 2.

It is contemplated that it is possible to make the mixture of catalyst by feeding lump or particles of black tourmaline, obsidian and bauxite with the above mentioned mixing ratio into a crusher and then crushing and mixing the components one at a time.

Tourmaline such as black tourmaline has a polarity characteristic and is polarized with positive electric charge at one end and with minus electric charge at the other end by heat or pressure, which ionizes air and water in the vicinity.

The obsidian contained in the liquid fuel reforming catalyst 2 transfers heat to the black tourmaline by emitting far-infrared radiation, and the alumina contained in the liquid fuel reforming catalyst 2 imposes pressure on the black tourmaline with the micro-vibration caused by bimetal effect.

As described above, the liquid fuel reforming catalyst 2 is constituted in order to reform the liquid fuel 8 in the vicinity of the catalyst into fuel with efficient combustion characteristic by minus-ionizing the fuel with the black tourmaline which is self-polarized by the heat and pressure from the obsidian and the alumina.

As described in example 1 of the preferred embodiment, it is preferable to use black tourmaline, which has strong self-polarization characteristic, for the tourmaline in the liquid fuel reforming catalyst, however, it is further contemplated that it is possible to use any ore, such as the other kind of tourmaline or black silica, which also has a characteristic to minus-ionize air and water in the vicinity.

It is further contemplated that the mixing ratio of the black tourmaline in the liquid fuel reforming catalyst 2 is preferably to be 5-15% by unit weight. The lower mixing ratio does not show enough ability of ionization and the higher mixing ratio does not bring enough ability of ionization either because its polarity is distinguished at the close distance of plus and minus electric charge.

Obsidian is preferred for the far-infrared emitting substance because obsidian transfers the surrounding heat energy effectively to the black tourmaline in the liquid fuel reforming catalyst by emitting far-infrared radiation; however it is contemplated, that any ore which emits far-infrared radiation can be used.

The mixing ratio of obsidian contained in the liquid fuel reforming catalyst 2 is preferably 5-15% by unit weight in order to keep proper distribution and balance with the other composites of the catalyst.

It is preferable to use bauxite for the alumina and binding material because the bauxite can be calcined below 950 Deg. C over which the polarity characteristic of black tourmaline disappears, however, any clay which can be calcined below 900 Deg. C, can be used for mixing with black tourmaline, obsidian and alumina for the catalyst.

It is also contemplated that the mixing ratio of the bauxite contained in the liquid fuel reforming catalyst 2 is preferably to be 70-90% by unit weight with which the bauxite keeps the proper distance of each electric charge between the black tourmaline particles and transfers its micro-vibration energy effectively to the black tourmaline.

FIG. 1 shows a reason why the preferred shape of the liquid fuel reforming catalyst 2 is formed into spherical shapes of 2-3 mm diameter to provide enough surface area of the catalyst and to ionize the liquid fuel 8 effectively, and also optimize liquid fuel 8 passing through the catalyst. The liquid fuel 8 of the liquid fuel reforming catalyst 2 is preferably 0.5-5 mm.

The shape of liquid fuel reforming catalyst 2 is not limited to sphere as shown in the preferred embodiment example 1 but other contemplated shapes include but are not limited to rice-grain shape or polyhedron which can keep enough opening space between the catalyst particles.

In the preferred embodiment example 1 as shown in FIG. 1, the liquid fuel reforming catalyst 2 shows the strong minus-ionization characteristic because the bauxite generates micro-vibration and the polarity of the black tourmaline becomes stronger after being calcined at 800 Deg. C.

The liquid fuel reforming catalyst 2 before being calcined can minus-ionize in the range of 2-3 mm vicinity, however, the liquid fuel reforming catalyst 2 after being calcined at 800 Deg. C becomes minus-ionize in the range of 18 mm vicinity.

It is preferable to calcine the liquid fuel reforming catalyst 2 at 700-900 Deg. C because the polarity characteristic of black tourmaline disappears over 950 Deg. C.

In case of the preferred embodiment example 1 shown in FIG. 1, the liquid fuel reforming device 1 is consisted of the cylindrical container 3 which is filled with the liquid fuel reforming catalyst 2 and equipped with the inlet part 6 and the outlet part 7 for the liquid fuel 8.

Inside the container 3, one or more buffer plates 4 with size reducing holes 5 is equipped and the buffer plate 4 regulates the flow of liquid fuel and distributes the influx evenly by reducing and spreading action by the buffer plate 4 and then the contact of fuel with the catalyst 2 is increased.

In the preferred embodiment example 1, the inlet part 6 and the outlet part 7 are equipped with the inlet cylindrical pipe 6*a* and the outlet cylindrical pipe 7*a* of which each one end is closed and the each other end is connected to the fuel pipe 11. The closed end of the inlet pipe 6*a* and the outlet pipe 7*a* are inserted in the container 3 and the inserted pipes have passing multi-holes 9 which are smaller than the diameter of liquid fuel reforming catalyst 2.

In this configuration the liquid fuel 8 flows radically into the container 3 from the passing holes 9 of the inlet pipe 6*a* and goes out of the passing holes 9 of the outlet pipe 7*a* after enough contact with the liquid fuel reforming catalyst 2.

Figure 2:
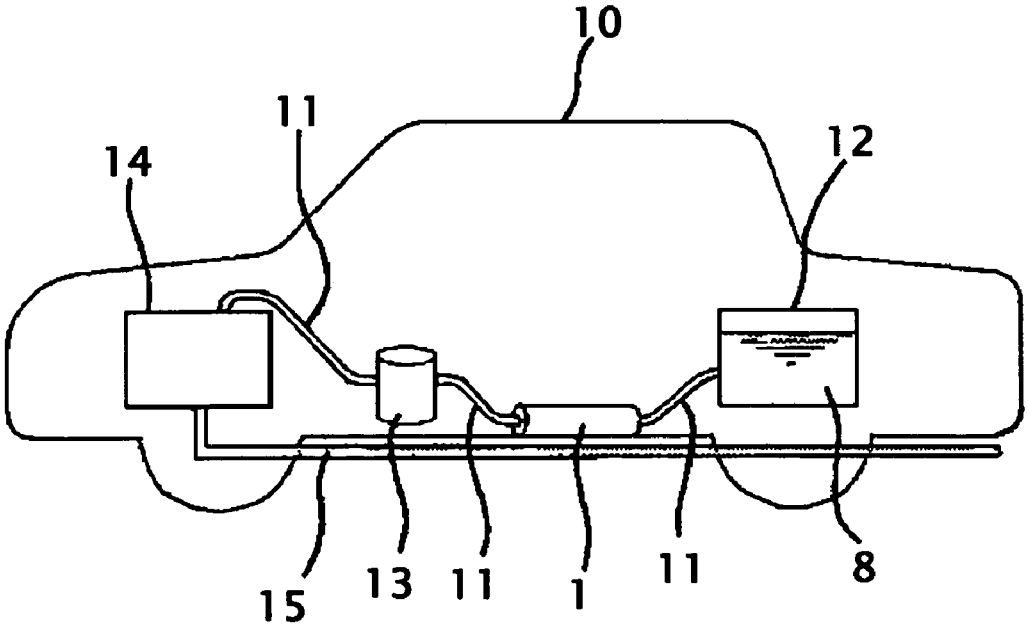
FIG. 2 shows a side view of the liquid fuel reforming device in a preferred embodiment.

Referring now to FIG. 2, the above mentioned liquid fuel reforming device 1 is connected to the fuel pipes 11 with the inlet part 6 and with the outlet part 7 between the fuel tank 12 and the fuel filter 13 on the vehicle 10, the liquid fuel 8 is reformed into the fuel with efficient combustion characteristic passing through the liquid fuel reforming device 1 where it is fed from the fuel tank 12 to the engine 14 through fuel pipe 11.

Therefore it is possible to feed the reformed liquid fuel to the engine 14 and to increase the power output and fuel economy of the engine and also to reduce PM in the exhaust gas.

Furthermore, by installing the liquid fuel reforming device 1 between the fuel tank 12 and the fuel filter 13, the damage of engine 14 by the contamination of catalyst particles can be avoided by the fuel filter 13 even if such catalyst particles flow out of the passing holes 9 or the buffer plate 4.

In case of the preferred embodiment shown in FIG. 2, the liquid fuel reforming device 1 is installed near the exhaust pipe 15 in order to transfer the heat of exhaust gas from the exhaust pipe 15 to the liquid fuel reforming catalyst 2 and improving the ionization ability by increasing the self-polarization characteristic of the black tourmaline in the catalyst.

It is preferable to layout the liquid fuel reforming device 1 in the vicinity of heat source of engine 14, oil pan or radiator of vehicle, but shall not be limited by the preferred embodiment example 1 shown in FIG. 2.

The liquid fuel reforming device 1 is possibly installed near a vibration source such as the engine 14 in order to increase the ionization ability of the black tourmaline in the liquid fuel reforming catalyst 2 for the liquid fuel reforming device 1 to receive the vibration energy which is conducted from the engine 14.

In another contemplated configuration a vibration is provided on or near the device 1 to add agitation on the liquid fuel reforming device 1.

In another contemplated embodiment, the liquid fuel reforming device 1 is applied not only to the vehicle as shown in the preferred embodiment example 1 but also to various kinds of internal combustion engine such as but not limited to for ship or power generator, thus the device can reform various kind of liquid fuel such as but not limited to gas oil, heavy oil and gasoline.

Thus, specific embodiments of a liquid fuel reforming device have been disclosed. It should be apparent, however, to those skilled in the art that many more modifications besides those described are possible without departing from the inventive concepts herein. The inventive subject matter, therefore, is not to be restricted except in the spirit of the appended claims.

ITEM NUMERICAL DESCRIPTION

1 Liquid fuel reforming device
2 Liquid fuel reforming catalyst
3 Container
4 Buffer plate
5 Size-reducing holes
6 Inlet part
6*a* Inlet pipe
7 Outlet part
7*a* Outlet pipe
8 Liquid fuel
9 Passing hole
10 Vehicle
11 Fuel pipe
12 Fuel tanks
13 Fuel filter
14 Engine
15 Exhaust gas pipe

What is claimed is:

1. A liquid fuel reforming catalyst comprising:

a catalyst of tourmaline, far-infrared radiation emitting substance, alumina and binding material crushed into powder, mixed, granulated and calcined for liquid fuel reforming.

2. The liquid fuel reforming catalyst from claim 1 wherein the catalyst is formed into particles with diameter of 0.5-5 mm.

3. The liquid fuel reforming catalyst from claim 1 wherein the catalyst is tourmaline or black tourmaline.

4. The liquid fuel reforming catalyst from claim 3 wherein the black tourmaline in the catalyst is 5-15% by unit weight.

5. The liquid fuel reforming catalyst from claim 1 wherein the far-infrared radiation emitting substance in the catalyst is obsidian.

6. The liquid fuel reforming catalyst from claim 5 wherein the obsidian in the catalyst is 5-15% by unit weight.

7. The liquid fuel reforming catalyst from claim 1 wherein the alumina and binding material in the catalyst is 70-90% by unit weight.

8. The liquid fuel reforming catalyst from claim 3 or 5 wherein the catalyst is calcined at 700-900 Deg. C.

9. The liquid fuel reforming catalyst from claim 1 wherein the catalyst is enclosed in an enclosure device where liquid fuel flows through the catalyst located with the enclosure device.

10. The liquid fuel reforming catalyst from claim 9 wherein the enclosure device is filled with the liquid fuel reforming catalyst in a container which has the inlet and the outlet for liquid fuel.

11. The liquid fuel reforming catalyst from claim 10 wherein the enclosure device is installed in a vehicle near an engine, exhaust gas pipe, oil pan or radiator of vehicle.

* * * * *